US007255587B2

(12) United States Patent
Boeck et al.

(10) Patent No.: US 7,255,587 B2
(45) Date of Patent: Aug. 14, 2007

(54) ELECTRIC PLUG AND ELECTRIC PLUG SOCKET

(75) Inventors: Werner Boeck, Gross-Umstadt (DE); Ralf Schmidt, Fuerth (DE); Guenter Feldmeier, Lorsch (DE); Martin Szelag, Bickenbach (DE)

(73) Assignee: Tyco Electronics AMP GmbH, Bensheim (DE)

( * ) Notice: Subject to any disclaimer, the term of this patent is extended or adjusted under 35 U.S.C. 154(b) by 0 days.

(21) Appl. No.: 11/196,872

(22) Filed: Aug. 4, 2005

(65) Prior Publication Data

US 2006/0030192 A1 Feb. 9, 2006

(30) Foreign Application Priority Data

Aug. 5, 2004 (DE) ..... 10 2004 038 123

(51) Int. Cl.
*H01R 13/627* (2006.01)

(52) U.S. Cl. ..... 439/358; 439/354

(58) Field of Classification Search ..... 439/354, 439/357, 358, 606, 594
See application file for complete search history.

(56) References Cited

U.S. PATENT DOCUMENTS 4,544,220 A * 10/1985 Aiello et al. ..... 439/594
4,884,978 A * 12/1989 Inaba et al. ..... 439/352
5,169,336 A * 12/1992 Taguchi ..... 439/489
5,246,380 A * 9/1993 Kodama ..... 439/354
5,624,271 A * 4/1997 Childs et al. ..... 439/352
5,938,470 A * 8/1999 Kashiyama ..... 439/489
6,179,643 B1 * 1/2001 Fukuda ..... 439/358
6,332,800 B2 * 12/2001 Kodama ..... 439/357
6,585,536 B1 7/2003 Wu
6,592,404 B2 * 7/2003 Endo ..... 439/595
6,761,488 B2 * 7/2004 Weigel ..... 385/58
6,887,104 B2 * 5/2005 Lee ..... 439/606

FOREIGN PATENT DOCUMENTS

| | | |
|---|---|---|
| DE | 39 32 709 A1 | 4/1991 |
| DE | 201 06 297 U1 | 8/2001 |
| DE | 101 10 470 A1 | 9/2002 |
| DE | 100 28 407 B4 | 3/2005 |
| WO | WO 01/20729 A1 | 3/2001 |
| WO | WO 02/15340 A1 | 2/2002 |
| WO | WO 02/15343 A1 | 2/2002 |

* cited by examiner

*Primary Examiner*—Tho D. Ta
(74) *Attorney, Agent, or Firm*—Barley Snyder LLC

(57) ABSTRACT

A plug (10) for connecting to a plug socket comprises a plug contact region (18) having one or more contacts for producing one or more electrical connections between the plug (10) and the plug socket. The plug also comprises a latch spring (32) having a first plug latching element (36) for connecting the plug (10) to a first socket latching element of the plug socket and a second plug latching element (38) for latching the plug (10) to a second socket latching element of the plug socket.

22 Claims, 10 Drawing Sheets

ELECTRIC PLUG AND ELECTRIC PLUG SOCKET

FIELD OF THE INVENTION

The present invention relates to electrical connectors and more particularly to an electric plug and an electric plug socket, which may be latched to each other by latching elements.

BACKGROUND

A number of electric plugs and electric plug sockets for receiving the plugs is known in the art. These plugs differ primarily in terms of the number, shape, size and arrangement of the contacts, the protection from electromagnetic interference, high-frequency characteristics, and the ampacity. An important feature of electric plugs and plug sockets are fastening or locking devices for the permanent, but generally detachable, fastening or locking of the plug in the plug socket. Whereas the conventional banana plug, the euro mains plug and the plug with earthing contact, for example, are held in the corresponding sockets or outlets merely as a result of the friction of the plug connection, other plugs are held in or on the plug socket using bayonet arrangements, coupling rings or screw flanges.

In the electrical connector industry, latching connections have been found to be particularly advantageous for fastening of an electric plug in or on an electric plug socket. The plug and plug socket are generally connected automatically during insertion of the plug into the plug socket in that latching elements of the plug and plug socket engage with one another. The latching connection may generally easily be released in that one latching element is displaced relative to the other latching element transversely to the insertion direction such that the two latching elements no longer engage. A tensile connection between the plug and plug socket may thus be rapidly made in a particularly simple manner, and subsequently released, via this latching connection. In many cases, a tool is not required even to release the latching connection.

An example of an electric plug that may be fastened in a plug socket by latching is disclosed in WO 02/15340 A1. In that reference, the electric plug comprises a plurality of contacts in a plug contact region on one side. On an opposing side of the plug contact region, a symmetrical pair of latch hooks is arranged on a latch spring. This pair of latch hooks is the only latching element of the plug and may be displaced by pressing an actuating handle in order to release a latching connection.

One drawback of the described conventional plug is that the latching connection of the plug and the plug socket cannot ensure a sufficiently secure connection for industrial use.

SUMMARY

An object of the present invention is to provide an electric plug, an electric plug socket and a frame for a plug socket which allow a sturdier connection between the plug and the plug socket.

The present invention will be described in various embodiments of a plug for connecting to a plug socket, which comprises a plug contact region having one or more contacts for producing one or more electrical connections between the plug and the plug socket. The electric plug also includes a latch spring having a first plug latching element for latching the plug to a first socket latching element of the plug socket and a second plug latching element for latching the plug to a second socket latching element of the plug socket.

The present invention also provides a plug socket for connecting to a plug, which comprises a plug contact region comprising one or more contacts for producing one or more electrical connections between the plug socket and the plug. The plug socket also includes a first socket latching element for latching the plug socket to a first plug latching element of the plug and a second socket latching element for latching the plug socket to a second plug latching element of the plug.

BRIEF DESCRIPTION OF THE DRAWINGS

Embodiments of the present invention will be described below in greater detail with reference to the accompanying drawings, in which.

DETAILED DESCRIPTION OF THE EMBODIMENTS

Figure 1:
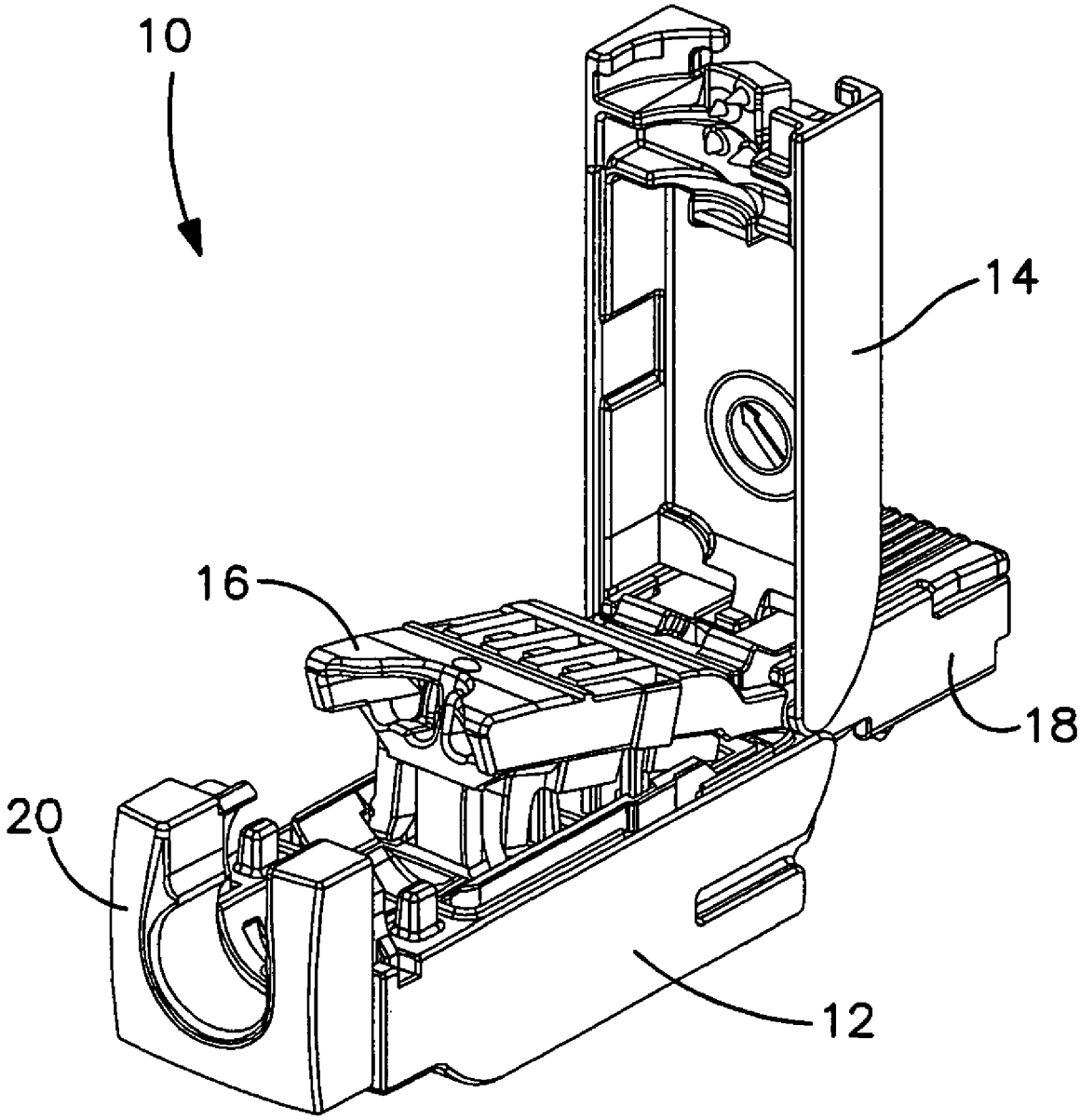
FIG. 1 is a perspective view of a first embodiment of the present invention.

The plug 10 as shown in FIG. 1 comprises a first housing half 12 and a second housing half 14, which are connected to each other so as to be able to swivel. FIG. 1 shows the two housing halves 12, 14 in an open position, in which, as will be described below in greater detail with reference to FIG. 2, a cable 22 may be inserted into the plug 10. A cable end socket 16, is also connected to the housing halves 12, 14. The cable end socket 16 may be swivelled about the same axis about which the second housing half 14 may be swivelled relative to the first housing half 12. The cable end socket 16 comprises a plurality (in the present first embodiment, four) of channels into which individual conductors of a cable 22 to be connected to the plug 10 may be placed or inserted.

A plug contact region 18 is connected to one of the housing halves 12, 14, for example, in the first embodiment described here, to the first housing half 12. A closure piece 20 is rotatably connected to one of the two housing halves 12, 14, for example, in the first embodiment illustrated here, to the first housing half 12. The closure piece 20 is rotatable about an axis that coincides with the position of a cable 22 when the cable 22 is inserted in the plug 10 and the plug 10 is closed. In other words, the closure piece 20 is rotatable about a cable 22 that is inserted into the closed plug 10. The closure piece 20 is substantially U-shaped. In FIG. 1, it is illustrated in a position in which the opening of the U points toward the second housing half 14, so that a cable 22 may be inserted into the plug 10. The closure piece 20 comprises an opening for receiving a screwdriver, with which the closure piece 20 may be turned. Alternatively or additionally, the closure piece 20 comprises two mutually opposing plane-parallel surfaces, to which an open-end wrench may be applied in order to turn, and thus to close or open, the closure piece 20.

Figure 2:
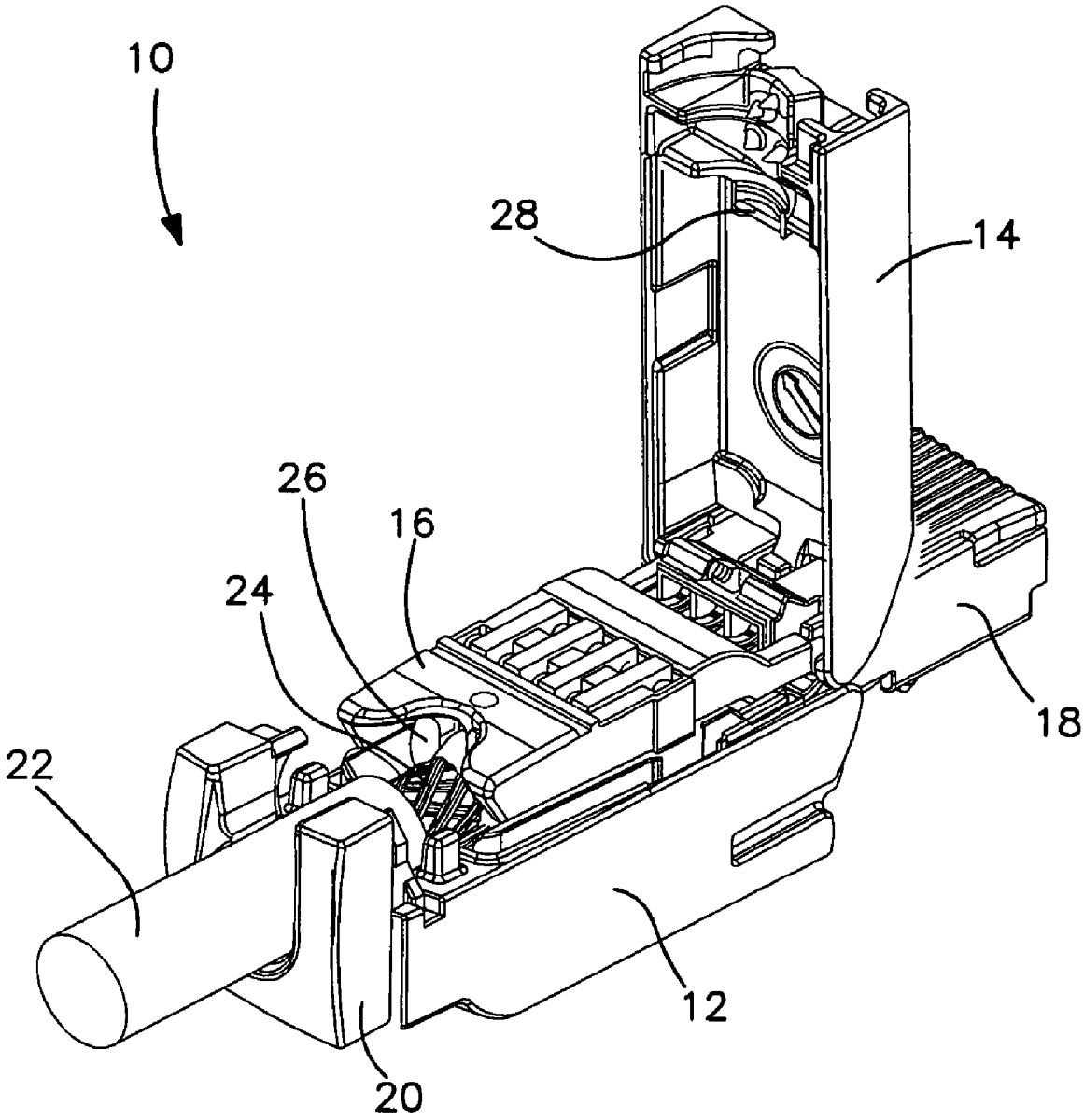
FIG. 2 is a further perspective view of the first embodiment.

FIG. 2 is a further perspective view of the plug 10 according to the first embodiment of the present invention. In this view, a cable 22 has already been inserted into the plug 10. Individual conductors 26 of the cable 22 are exposed in an end portion of the cable 22 and introduced into the channels of the cable end socket 16. A shield 24 is exposed in an adjacent portion of the cable 22.

By swiveling the cable end socket 16 toward the first housing half 12, the individual conductors 26 are contacted. This takes place by means of cutting contacts the first housing half 12 which cut the insulation of each individual conductor 26 and contact the individual conductors 26. Alternatively, crimping contacts, piercing contacts, etc. may be used.

The exposed shield 24 of the cable 22 is contacted by the first housing half 12, during downward swiveling of the cable end socket 16, by a conductive portion (not shown) of the first housing half 12, and during downward swiveling of the second housing half 14 to the first housing half 12, by a conductive portion 28 of the second housing half 14. The conductive portion of the first housing half 12 and the conductive portion 28 of the second housing half 14 are electrically connected to conductive coatings, metal coatings or metallic inserts of the housing halves 12, 14, which shield the plug 10 from electromagnetic interference when closed. According to a variant, the housing halves 12, 14 are made entirely of metal, for example as pressure die-cast parts, which provide shielding protection and a particularly high degree of mechanical robustness.

Figure 3:
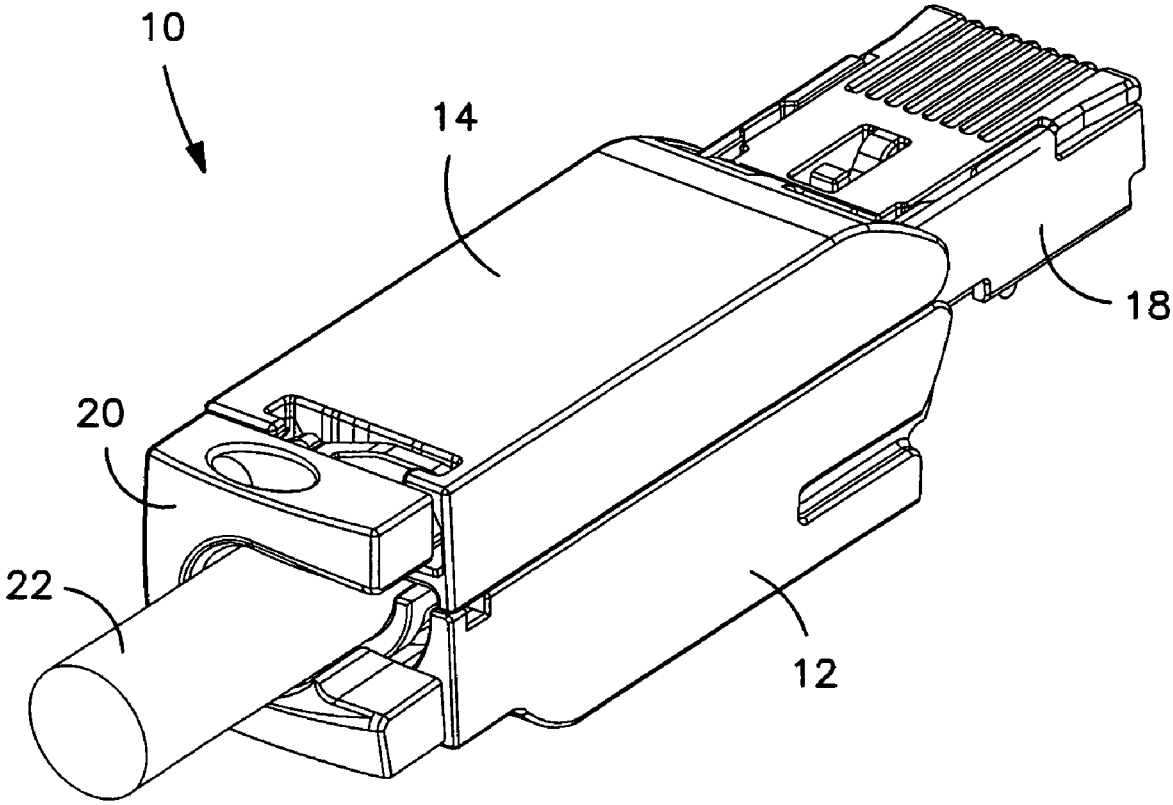
FIG. 3 is a further perspective view of the first embodiment.

FIG. 3 is a further perspective view of the plug 10 according to the first embodiment. The plug 10 is shown here in a closed state, in which the second housing half 14 is swivelled toward the first housing half 12. When closed, as mentioned above, the shield 24 of the cable 22 is contacted by conductive portions on both housing halves 12, 14, thus ensuring protection from electromagnetic radiation. Moreover, when the plug 10 is closed, the cable 22 is held by clamping between the housing halves 12, 14.

It may also be seen in FIG. 3 that the closure piece 20 has been rotated by 90° about the cable 22 compared to the views in FIGS. 1 and 2. In this locked position, the closure piece 20 holds the housing halves 12, 14 together or locks them in the closed position.

Figure 4:
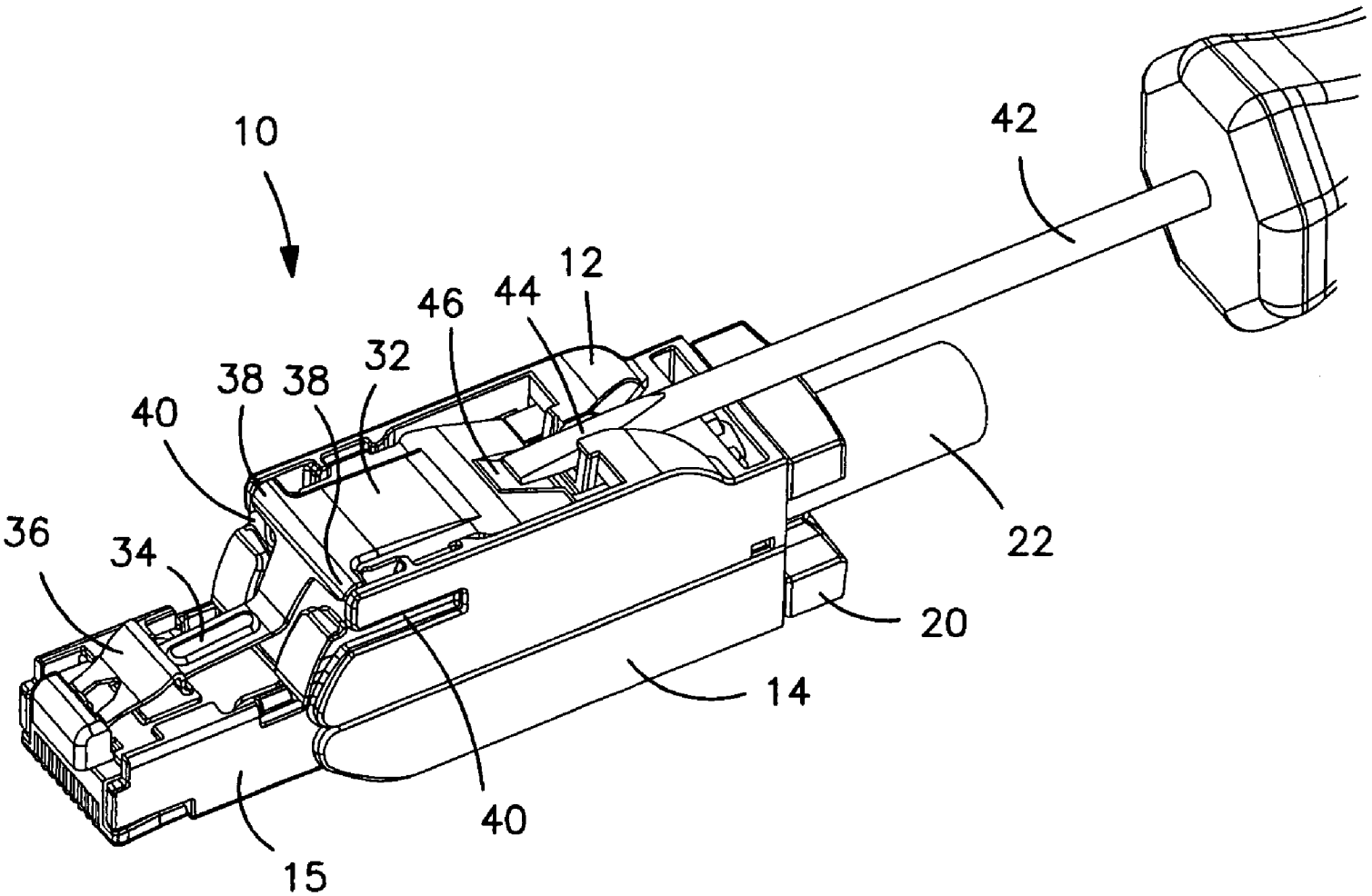
FIG. 4 is a further perspective view of the first embodiment.

FIG. 4 is a further perspective view of the plug 10 according to the first embodiment of the present invention. The plug 10 is shown in this case from a diametrically opposing perspective. In particular, a lower side, which is concealed in FIG. 1 to 3, of the first housing half 12 may be seen. A latch spring 32 is arranged on the lower side of the first housing half 12. The latch spring 32 preferably consists of a stamped and formed metal sheet and exhibits locally varying resilient properties depending on its local configuration. The latch spring 32 is connected captively, but movably, to the first housing half 12. It is displaceable between the locked position illustrated in FIG. 4 and an unlocked position described below. The latch spring 32 is thus integrated into the housing of the plug 10, in particular into the first housing half 12, in so far as it does not protrude or does not substantially protrude, from the first housing half 12.

The latch spring 32 comprises a portion 34 which extends parallel to the plug contact region 18. The end of this portion 34 is configured in the shape of a latching element 36, which approximately exhibits the profile of a saw tooth. The shape, size and arrangement of the first latching element 36 are such that, on insertion of the plug 10 into a plug socket provided for this purpose, the first latching element 36 latches with a corresponding latching element on the plug socket 70.

In the first embodiment shown here of the present invention, the plug contact region 18 and the first latching element 36 are configured so as to be compatible with an RJ45 socket. In other words, the plug 10 may be inserted like a conventional RJ45 plug into an RJ45 socket, where it latches with the first latching element 36.

However, in addition to the first latching element 36, the plug 10 according to the invention also comprises a second latching element in the form of two noses 38, which are configured symmetrically on the latch spring 32. The noses 38 are located outside the plug contact region 18, in the region of the first housing half 12. The noses 38 do not correspond to the RJ45 standard. They are provided for a latching connection with latching elements on a plug socket that also differs correspondingly from the RJ45 standard. This latching connection will be described below in greater detail with reference to FIGS. 10 and 11.

Grooves 40 are provided in the side walls of the first housing half 12, in proximity to the noses 38 on the latch spring 32. The grooves 40 are located parallel to an insertion direction, in which the plug 10 may be inserted into a plug socket 70. The grooves 40 are used, together with corresponding webs on the plug socket 70, for guiding the plug 10 in the plug socket 70. They ensure, in particular, a reliable latching connection of the plug 10 via the noses 38, in that they ensure exact guidance of the plug 10 in the region of the noses 38 and hence exact orientation of the noses 38 relative to corresponding latching elements on the plug socket 70.

A latching connection of the plug 10 with a plug socket via the first latching element 36 and/or the noses 38 may be released by pressing the latch spring 32 and displacing it toward the second housing half 14. This may be done manually or using a screwdriver 42, which is inserted substantially parallel to the cable 22 through a guide or opening 44 in the first housing half 12. The tip of the screwdriver 42 presses against the latch spring 32 at a ramp 46. The latching spring 32 is accordingly displaced and latching connections of the first latching element 36 and the noses 38 released from corresponding latching elements of a plug socket 70 as will be described below.

Figure 5:
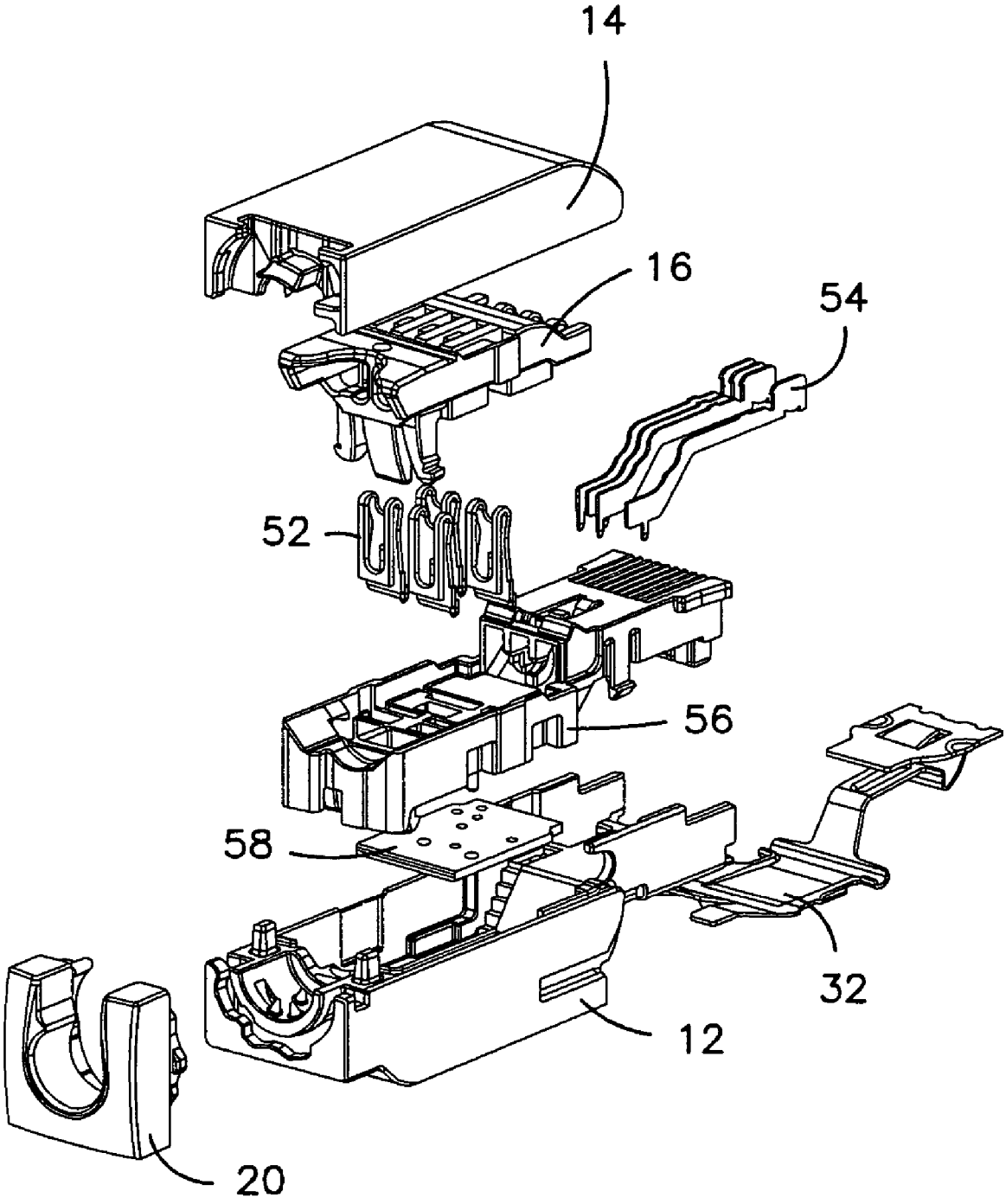
FIG. 5 is a perspective exploded view of the first embodiment.

FIG. 5 is a perspective exploded view of the components of the plug 10 according to the first embodiment of the preset invention. The closure piece 20, like the housing halves 12, 14, may be made of metal or alternatively of plastic material. Insulation displacement contacts 52 and flat contacts 54, like the latch spring 32, are also made by stamping and forming sheet metal. The cable end socket 16 and an insulating housing 56 consist of an electrically insulating material, for example plastic material. The insulation displacement contacts 52 and the flat contacts 54 are inserted in pockets or recesses in the insulating housing 56 and are electrically connected to one another in pairs via conductor tracks (not shown) on a printed circuit board 58.

Figure 6:
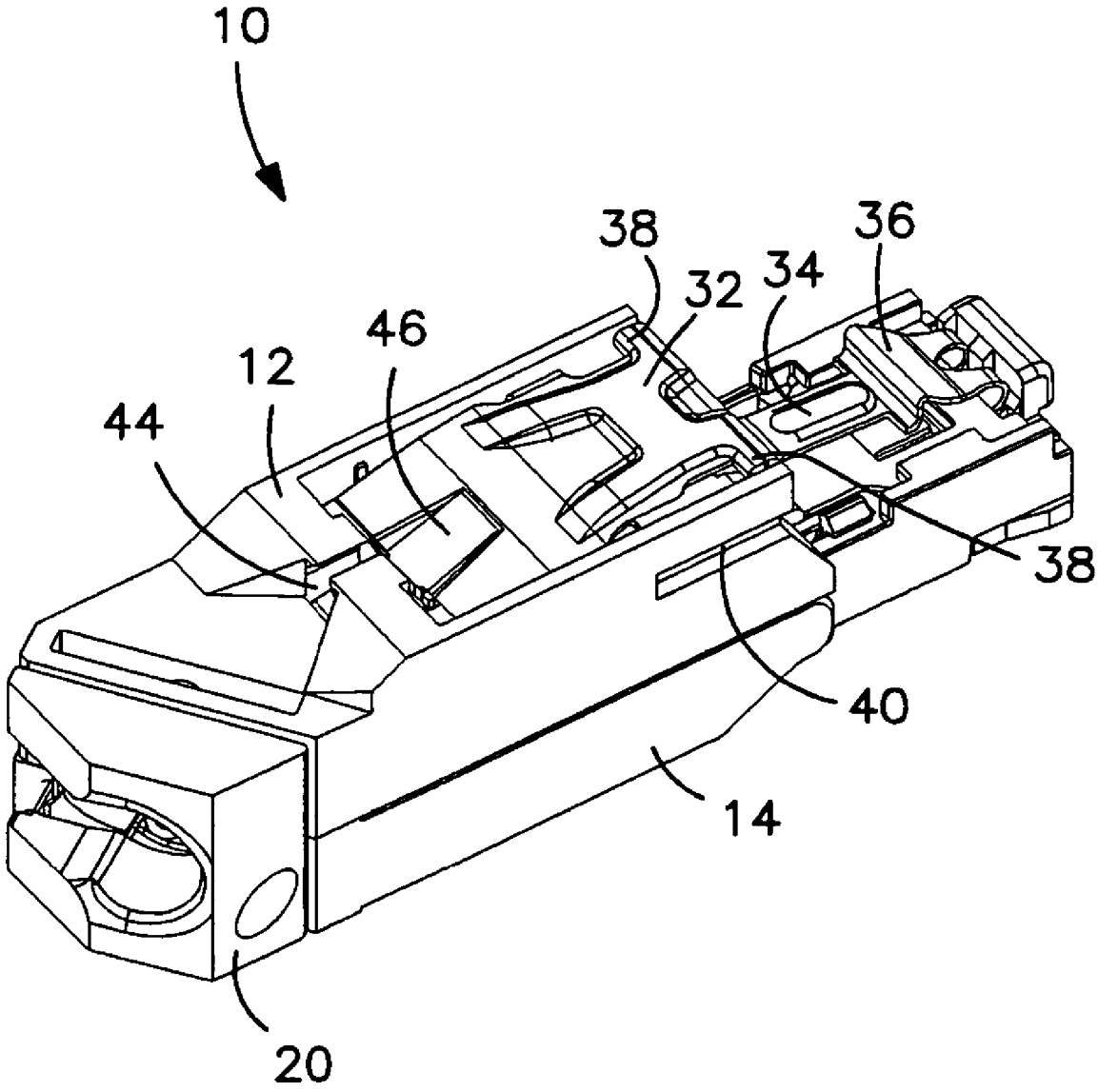
FIG. 6 is a perspective view of a second embodiment of the present invention.

FIG. 6 is a perspective view of a plug 10 according to a second embodiment of the present invention. This embodiment differs from the embodiments illustrated above with reference to FIG. 1 to 5 in that a cable 22 may be connected to the plug 10, not parallel to the insertion direction, but rather at an angle of approximately 45° relative to the insertion direction, or enters the plug 10 at this angle. Accordingly, the axis about which the closure piece 20 is rotatable is arranged at the same angle relative to the insertion direction.

In a corresponding configuration of the housing halves 12, 14, the cable end socket 16, the latch spring 32, the insulation displacement contacts 52, the flat contacts 54, the insulating housing 56 and optionally, also the closure piece 20 may be identical in their construction to those from the first embodiment.

Figure 7:
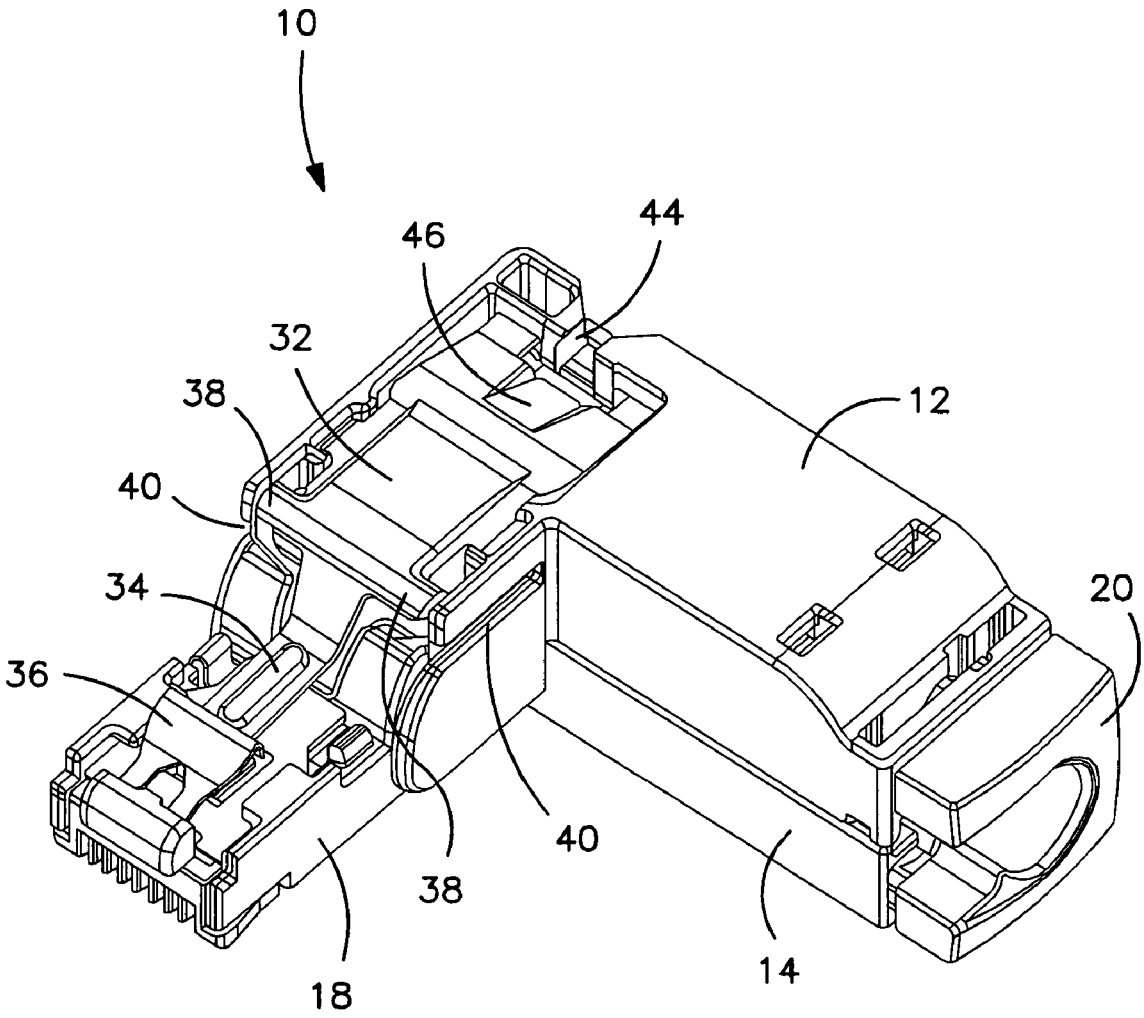
FIG. 7 is a perspective view of a third embodiment of the present invention.

FIG. 7 is a perspective view of a plug 10 according to a third embodiment of the present invention. This embodiment differs from the embodiments illustrated with reference to FIG. 1 to 6 in that a cable 22 may be connected to the plug 10 at an angle of 90° relative to the insertion direction. However, in contrast to the second embodiment illustrated with reference to FIG. 6, not only is the closure piece 20 arranged differently or the axis about which the closure piece 20 is rotatable arranged at a corresponding angle relative to the insertion direction; rather, the entire housing and especially the first housing half 12 is L-shaped, the plug contact region 18 being arranged at the end of one arm and the closure piece 20 at the end of the other arm.

In a suitable configuration of the first housing half 12, the second housing half 14, the cable end socket 16, the closure piece 20, the latch spring 32, the insulation displacement contacts 52 and the flat contacts 54 may be identical in their construction to those from the first embodiment.

Figure 8:
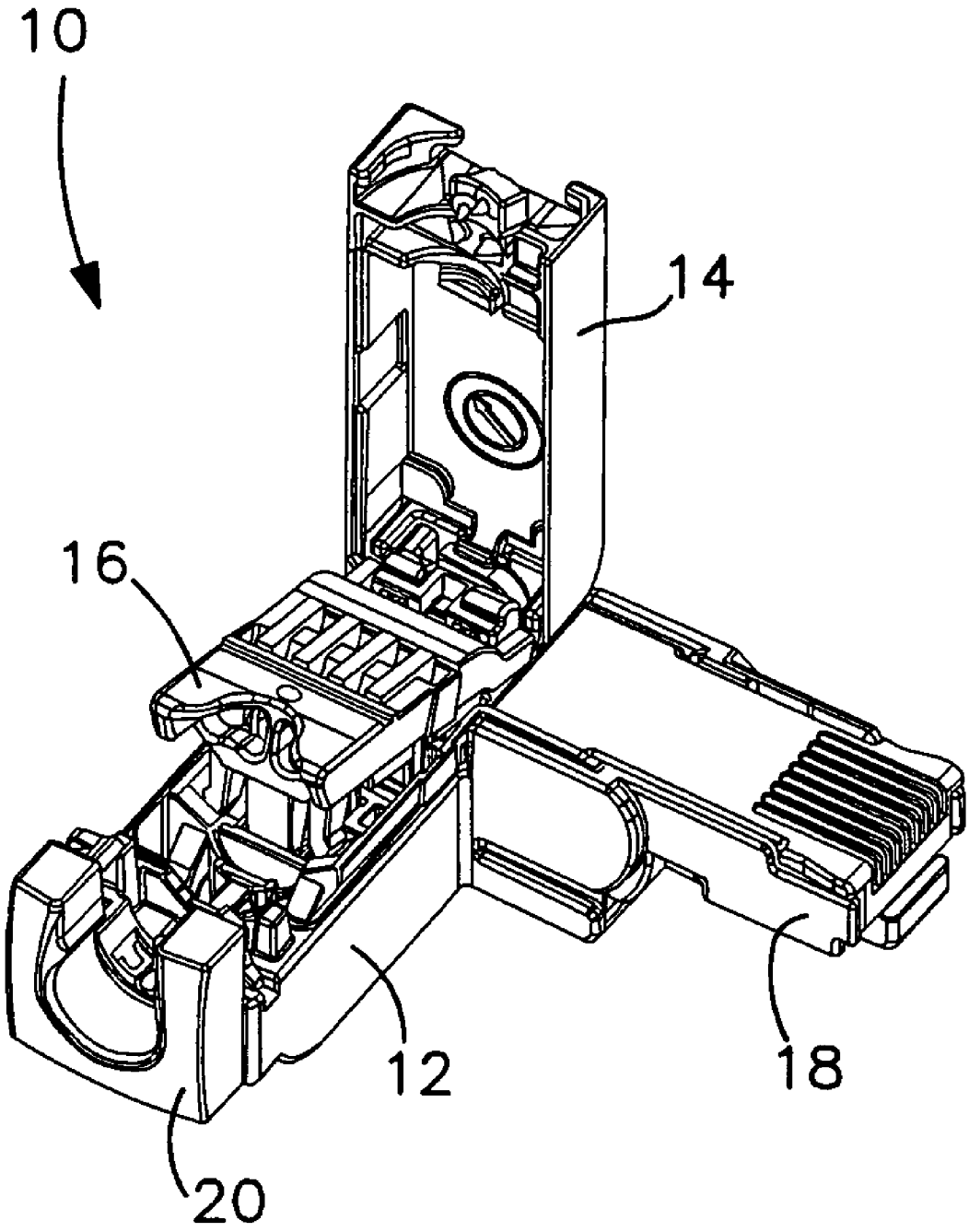
FIG. 8 is a further perspective view of the third embodiment.

FIG. 8 is a further perspective view of the plug 10, illustrated in FIG. 7, according to the third embodiment of the present invention. As in the view of the first embodiment in FIG. 1, the second housing half 14 and the cable end socket 16 are shown in an open position.

Figure 9:
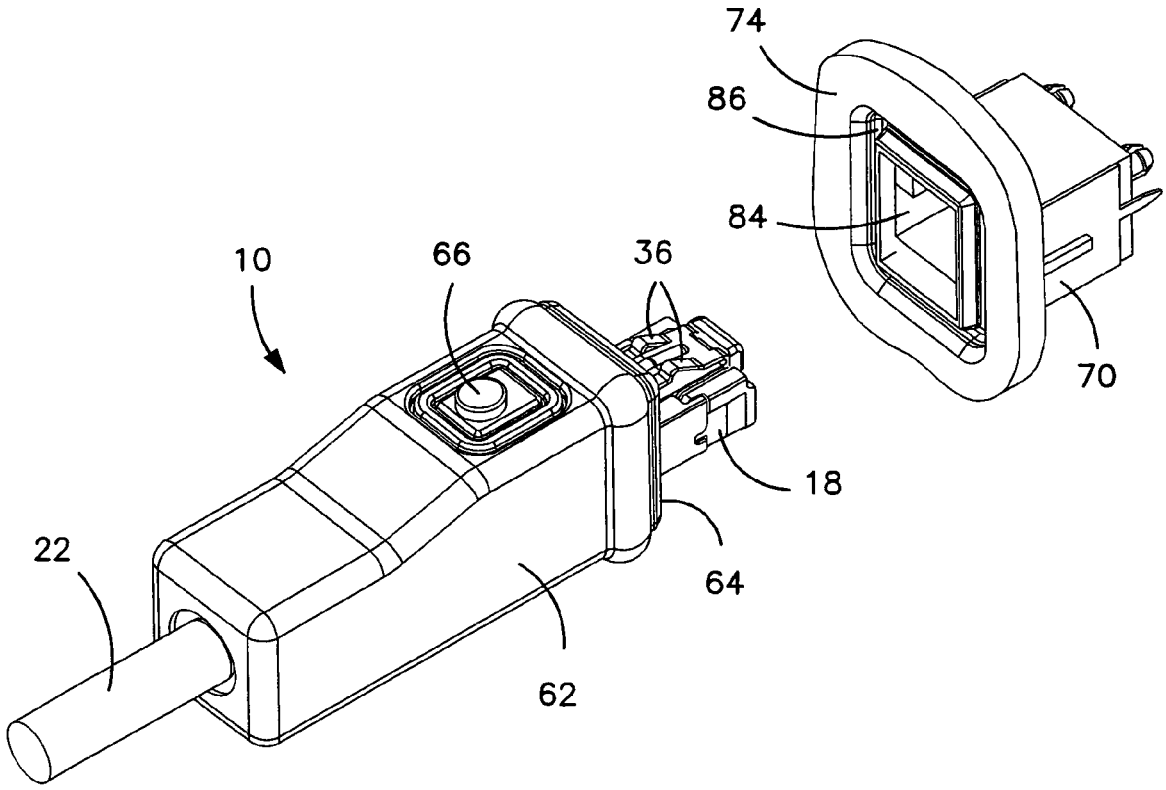
FIG. 9 is a perspective view of a fourth embodiment of the present invention.

FIG. 9 is a perspective view of a plug 10 according to a fourth embodiment of the present invention. This embodiment differs from those illustrated above in that the plug 10 is protected by a sealing sleeve 62. The sealing sleeve comprises a sealing edge 64 at its end facing the plug socket 70 and an unlocking button 66 on its lower side. The sealing sleeve 62, including the unlocking button 66 and the sealing edge 64 is preferably integrally formed of a resilient material, for example a plastic material or rubber.

Alternatively, the sealing sleeve 62 is made up of a plurality of pieces, the unlocking button 66 and/or the sealing edge 64 being made of one or two different resilient materials and being inserted into the sealing sleeve 62 by gluing, welding, latching, press-fitting or similar measures. In this case, the sealing sleeve 62 may be made of a resilient or else of a rigid material.

In any case, the sealing sleeve 62 substantially encloses the plug 10, apart from the plug contact region 18. In particular, the sealing sleeve 62 is also connected in a tight manner to the cable 22. This is achieved by the interlocking fit and/or by the resilience of the edge of the sealing sleeve that faces the cable. This sealing sleeve 62 therefore preferably comprises an O-ring or a similar sealing element, which fills and tightly closes an annular gap between the sealing sleeve 62 and the cable 22.

FIG. 9 also shows a plug socket 70 corresponding to the plug 10 in a housing wall 74, which is shown only in part. The plug socket 70 comprises a peripheral groove 86 around an opening 84, into which the plug contact region 18 of the plug 10 may be inserted. When the plug 10 is in the plug socket 70, the sealing edge 64 of the plug 10 engages with the groove 86 on the plug socket 70. The infiltration of gases, liquids and dust into the plug 10 and the plug socket 70 is prevented, as far as possible, as a result of the interlocking contact between the sealing edge 64 and groove 86 and as a result of the complete enclosure of the plug 10 by the sealing sleeve 62. Leakage currents or short-circuits between contacts caused by infiltrated conductive media or a conductive deposit on insulator surfaces, corrosion of the contacts caused by infiltrated corrosive media and a resulting increase in contact resistance between the contacts and an increased degree of wear caused by infiltrated dust may thus be substantially or completely prevented. The operating reliability of the plug 10 and plug socket 70 is thus substantially improved.

The first latching element 36 of the plug 10 consists in this case of two symmetrical hooks, which are formed on the latch spring 32, which was described above in relation to the first three embodiments. A second latching element, which corresponds to the noses 38 from the preceding embodiments, is concealed by the sealing sleeve in the view of FIG. 9. The first and the second latching element of the plug 10 engage with corresponding latching elements on the plug socket 70, which are also not shown. These corresponding latching elements may be arranged on the plug socket 70, for example protruding from said socket 70 in the insertion direction, in order to engage, behind the plane formed by the sealing edge 64, with the chamber enclosed by the sealing sleeve 62 and to latch with the second latching elements arranged in said chamber.

As in the preceding embodiments, the latching connection between the second latching elements of the plug 10 and plug socket 70 may replace or supplement the latching connection between the first latching elements, so the holding force is applied partly, predominantly or entirely by the latching connection between the second latching elements.

The unlocking button 66 acts directly or indirectly on the latch spring 32, so the latch spring 32 may be displaced into the above-described unlocked position, in which the latching connections between the second latching elements and optionally also the latching connection between the first latching elements are released, as a result of pressure on the unlocking button 66. The unlocking button accordingly comprises a resilient region, for example in the form of a flat bellows structure, at the edge.

The plug 10, illustrated in FIG. 9, according to the fourth embodiment is preferably derived from the plug, illustrated above with reference to FIG. 1 to 5, according to the first embodiment in that the sealing sleeve 62 is placed over the assembled plug, which is connected to the cable 22. This is also possible, given a corresponding configuration and resilience of the sealing sleeve 62, in the event of there being an angle between the insertion direction and the cable 22, for example as in the second and third embodiments. Fitting of the sealing sleeve 62 by flipping it over is particularly simple and may also easily be carried out in the case of a one-piece configuration of the sealing sleeve 62, which is made of a resilient material.

Figure 10:
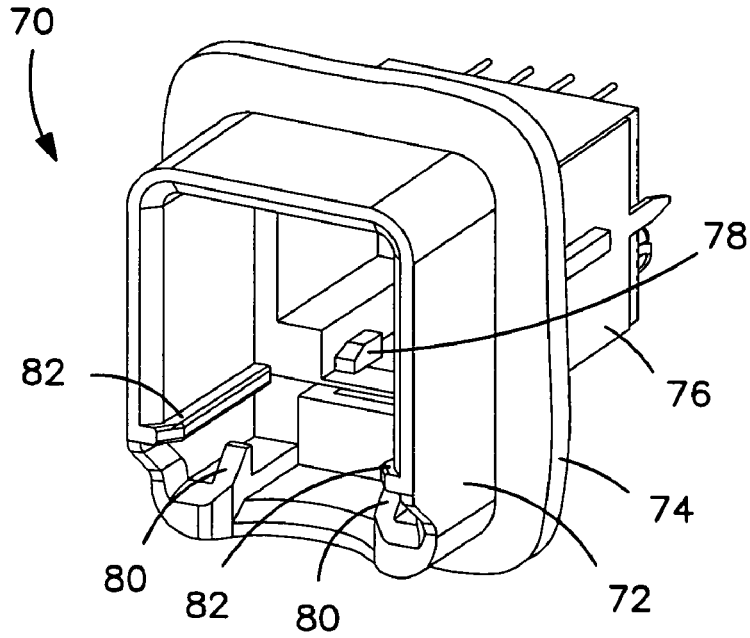
FIG. 10 is a perspective view of a fifth embodiment of the present invention.
Figure 11:
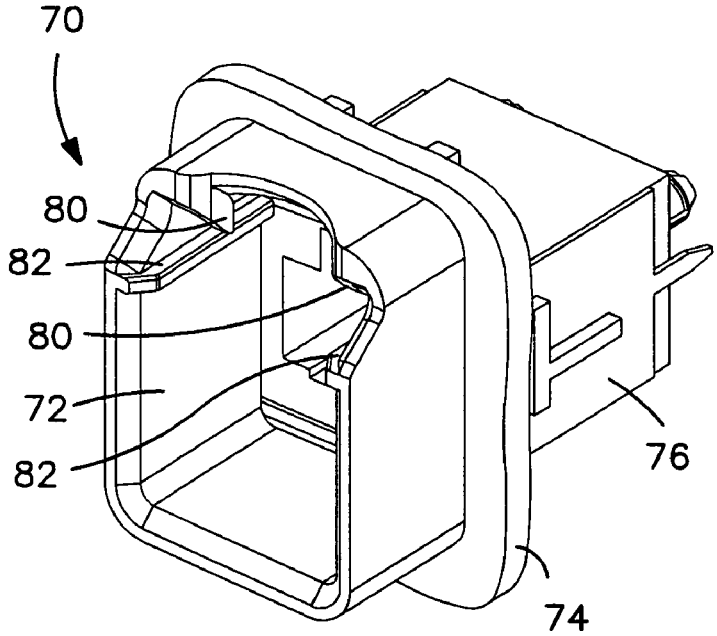
FIG. 11 is a further perspective view of the fifth embodiment.

FIGS. 10 and 11 are perspective views of a plug socket 70 according to a further embodiment of the present invention. FIGS. 10 and 11 show the plug socket 70 from two different perspectives, which differ as a result of rotation by 180° about the insertion direction. The plug socket 70 may either be integrally formed, especially for example of an integral plastic material injection-molded part, into which corresponding contacts are inserted, or consist of two joined parts. In both cases, the front part of the plug socket 70 is referred to as a frame 72, which is preferably arranged outside a housing wall 74 (shown in part) of a device housing. Alternatively, the frame 72 is embedded or sunk in the housing wall 74 or the leading edge of the frame 72 is flush with the housing wall 74.

The rear part 76, in turn, may correspond to the RJ45 standard, so as to be compatible with conventional RJ45 plugs. As the frame 72 has a relatively large clear cross-section and most conventional RJ45 plugs have an at most slightly enlarged cross-section, even outside the plug socket, this compatibility is also not limited or is not substantially limited by the frame 72. In the case of a two-piece construction of the plug socket 70, the frame 72 then preferably supplements a conventional RJ45 plug socket, which forms the rear part 76.

A beveled projection, which, together with a symmetrically arranged second beveled projection (not shown) forms a first latching element 78, as may be seen in FIG. 10. This first latching element 78 corresponds to the first latching element 36, which may be seen in FIGS. 4, 6 and 7, on the plug 10. When the plug 10 is inserted into the plug socket 70 the first latching element 36 of the plug 10 and the first latching element 78 of the plug socket 70 form a latching connection.

The plug socket 70, as may be seen both in FIG. 10 and in FIG. 11, also comprises a second latching element 80, which consists of two symmetrically arranged triangular teeth. On insertion of the plug 10 into the plug socket 70, the noses 38 on the latch spring 32 of the plug 10 form a latching connection with the two teeth of the second latching element 80 of the plug socket 70. The plug 10 is thus held in the plug socket 70 by means of two latching connections, i.e. by a latching connection of the first latching element 36 of the plug 10 with the first latching element 78, which consists of a pair of beveled projections, of the plug socket 70 and by a latching connection of the noses 38 with the second latching element 80, which consists of two triangular teeth. As a result of this double latching connection, the plug 10 is held particularly tightly and particularly securely in the plug socket 70. Both latching connections are released simultaneously, or at least approximately simultaneously, when the latch spring 32 is displaced manually or, as described above with reference to FIG. 4, using a screwdriver into an unlocked position.

The plug socket 70 also comprises a few symmetrically arranged webs 82 on opposing side walls of the frame 72. The webs 82 are arranged parallel to the insertion direction in which a plug 10 may be inserted into the plug socket 70. The webs 82 correspond to the grooves 40 on the plug 10 and ensure, together with said grooves, precise and reliable guidance of the plug 10 in the plug socket 70.

As may be recognized from the above remarks regarding the embodiments, the term "latching element", in the sense of the present patent application, also includes a couple of features arranged symmetrically with respect to the insertion direction. In particular, the two noses 38, the two beveled projections which form the first latching element 78 or the two triangular teeth, which form the second latching element 80 of the plug socket 70, are referred to in each case as a single latching element.

The present invention comprises, in addition to the above-illustrated embodiments, numerous other possible embodiments, which differ from the embodiments, for example in the configuration of the plug contact region 18 in the construction of the housing, in the locking mechanism thereof, in the configuration and arrangement of the latching elements 36, 38, 78, 80 in the arrangement of the cable or in devices for facilitating the unlocking, for example in the arrangement and orientation of the opening 44.

In particular, no parts of the plug 10 and the plug socket 70 may correspond to a standard, or a part of the plug 10 and a part of the plug socket 70 may correspond to a standard other than the RJ45 standard, for example a different RJ standard. According to a further alternative, the latching connection may be unlocked by turning or a different movement of a screwdriver in the opening 44, by means of a lever construction and/or via a key.

Instead of two noses 38 and a second latching element 80 consisting of two features, only one latching hook may be provided on the latch spring 32 and a corresponding feature, for example a recess or cut-out, on the plug socket 70, in order to form the second latching connection. Preferably, the latching hook and the feature corresponding thereto are in each case arranged centrally on the plug 10 and on the plug socket 70.

It was disclosed with reference to FIGS. 10 and 11 that the front portion of the plug socket 70 or the frame 72 is preferably arranged outside a housing wall 74 of a device housing. The frame 72 is preferably latched onto the housing in the insertion direction, or screwed to the housing or integrated with the rear part 76 of the plug socket 70 or the housing wall 74 as a one-piece cast part. Alternatively, the frame 72 is displaceably latched or screwed or connected by means of a plug-in connection, transversely or longitudinally to the insertion direction to the rear part 76 of the plug socket 70, or else is latched or screwed to the housing wall 74.

In the above embodiments, grooves 40 are provided on the plug 10 and corresponding webs 82 on the plug socket 70, in order to ensure precise and reliable guidance of the plug 10 in the plug socket 70. Alternatively, other means are provided for guiding the plug 10 in the plug socket 70 and for ensuring precise relative orientation of the latching elements 36, 38, 78, 80 on said plug, for example webs on the plug 10 and corresponding grooves on the plug socket, or outward guidance of the plug 10 in the plug socket 70.

The forgoing embodiments comprise a straight plug and plugs with angles of 45° and 90° between the insertion direction and the direction in which the cable issues from the plug 10. Moreover, the present invention may advantageously be carried out in adaptation to any applications and the spatial conditions to be taken into account, at any arbitrary angle between the cable and the insertion direction.

In the second embodiment illustrated above with reference to FIG. 6, the cable end socket 16 is arranged parallel to the insertion direction, while the direction of the cable differs from the insertion direction. Conversely, in the third embodiment illustrated above with reference to FIGS. 7 and 8, the cable end socket 16 is arranged parallel to the direction in which the cable 22 enters, while both are arranged at right angles to the insertion direction. According to a further variant, the cable end socket 16 assumes an arbitrary angle to the direction in which the cable 22 enters from the plug 10 and/or an arbitrary angle to the insertion direction.

According to the embodiment illustrated with reference to FIGS. 10 and 11, the plug socket 70 is provided for receiving a single plug 10. Alternatively, the plug socket 70 according to the invention is a multi-port or multi-plug socket for receiving a plurality of plugs 10 in a row, a two-dimensional grid or any other arrangement. The arrangement of two plug sockets 70 or two rows of plug sockets 70 "back-to-back" may be utilized, so if there are a plurality of plugs 10 inserted into the plug sockets, for example, the latch springs 32 or the unlocking buttons 66 of all of the plugs 10 are accessible for unlocking.

Advantageously, the present invention is based on the idea of providing, in a plug 10 and in a plug socket 70 or a frame 72 for supplementing a plug socket, in addition to corresponding and mutually latching first latching elements 36, 78 mutually corresponding second latching elements 38, 80 which form a second latching connection. As a result of this second latching connection between the plug 10 and the plug socket 70 or the frame 72, the mechanical connection between the two is substantially reinforced. Increased reliability of the plug connection is thus ensured even in harsh operating conditions, especially in industrial use. Either both latching connections simultaneously have a mechanically connecting effect or the mechanical connection is ensured predominantly or exclusively by the second latching connection.

The first latching elements 36, 78 and the second latching elements 38, 80 are preferably set apart from one another or offset relative to one another in the plug insertion direction, in which the plug 10 may be inserted into the plug socket 70. As a result, it is, in particular, possible that the plug contact region 18 and the first latching elements 36, 78 correspond to a standard, and a plug 10 according to the invention is thus combined with a conventional, standardized plug socket 70 or a conventional, standardized plug 10 is combined with a plug socket 70 according to the invention if the second latching elements 38, 80 are arranged outside the region in which the plug and the plug socket are standardized. This arrangement results in practical advantages of compatibility between standardized plugs or plug sockets which may include, for example, RJ plugs or RJ plug sockets and others.

What is claimed is:

1. A plug for connecting to a plug socket having a forwardly located frame and a rearwardly located rear part connected to the frame, the plug comprising:

a plug contact region adapted for insertion into the rear part of the plug socket and having one or more contacts for producing one or more electrical connections between the plug and the plug socket; and a latch spring comprising:

a first plug latching element for latching the plug to a first socket latching element which is associated with the rear part of the plug socket; and a second plug latching element for latching the plug to a second socket latching element which is associated with the frame of the plug socket.

2. The plug according to claim 1, further comprising a sealing sleeve, which at least partly surrounds the plug and protects a cable connection region and the contacts of the plug when the plug is in the plug socket.

3. The plug according to claim 1, further comprising a socket for receiving the tip of a screwdriver parallel to a plug insertion direction, wherein the latch spring may be displaced into an unlocked position by inserting the screwdriver into the socket or by turning the screwdriver in the socket, whereby a latching connection of the plug latching elements of the plug to the socket latching elements of the plug socket is released.

4. The plug according to claim 1, wherein a cable may be connected to the plug at an angle of 45° to a plug insertion direction.

5. The plug according to claim 1, wherein a cable may be connected to the plug at an angle of 90° to a plug insertion direction.

6. The plug according to claim 1, wherein the housing is made of metal or an insulator coated with an electrical conductor.

7. The plug according to claim 1, wherein the latch spring is made of metal.

8. The plug according to claim 1, wherein the first plug latching element and the second plug latching element are set apart from each other in a plug insertion direction.

9. The plug according to claim 8, further comprising a groove parallel to the plug insertion direction, for guiding the plug on a web in the plug socket.

10. The plug according to claim 9, wherein the plug comprises a housing into which the latch spring may be integrated.

11. The plug according to claim 10, wherein the housing further comprises a first housing half and a second housing half, which are connected to each other so as to swivel between an open position and a closed position, wherein in the open position, a cable may be inserted into the plug and wherein, in the closed position, the cable is mechanically and electrically connected to the plug.

12. The plug according to claim 11, further comprising a closure piece, which is connected to the first housing half so as to be able to rotate about the cable, the closure piece having a locked position in which it locks the first housing half and the second housing half to each other in the closed position.

13. A plug socket for connecting to a plug having a plug contact region, a separate upper housing half, and a latch spring, the plug socket comprising:

a rear part adapted to receive the plug contact region of the plug and having one or more contacts for producing one or more electrical connections between the plug socket and the plug;

a first socket latching element for latching the plug socket to a first plug latching element of the latch spring associated with the plug contact region of the plug; and a second socket latching element for latching the plug socket to a second plug latching element of the latch spring associated with the upper housing half of the plug.

14. The plug socket according to claim 13, wherein the first socket latching element and the second socket latching element are set apart from each other in a plug insertion direction.

15. The plug socket according to claim 14, further comprising a web parallel to the plug insertion direction, in which the plug may be inserted into the plug socket, for guiding a groove in the plug into the plug socket.

16. The plug socket according to claim 15, wherein the plug socket is incorporated into a device housing.

17. The plug socket according to claim 13, wherein a first portion of the plug socket, on which the plug contact region is arranged, is integral with a second portion of the plug socket, on which the second socket latching element is arranged.

18. The plug socket according to claim 17, wherein the first portion and the second portion are formed by an integral injection-molded part.

19. A frame for rigid connection to a plug socket, the frame comprising:

a frame latching element for rigidly connecting the frame to the plug socket; and a second socket latching element carried by the frame for latching the frame to a second plug latching element of a plug when the plug is inserted into the plug socket;

whereby a first plug latching element of the plug is latched to a first socket latching element carried by the plug socket; and wherein a substantial portion of the frame extends beyond the plug socket toward the plug.

20. The frame according to claim 19, further comprising one or more further frame latching elements or one or more screw connections for rigidly connecting the frame to the plug socket or to a housing wall.

21. The frame according to claim 20, wherein the frame is integral with a housing wall.

22. A plug for connecting to a plug socket, the plug comprising:

a plug contact region having one or more contacts for producing one or more electrical connections between the plug and the plug socket;

a latch spring comprising:

a first plug latching element for latching the plug to a first socket latching element of the plug socket; and a second plug latching element for latching the plug to a second socket latching element of the plug socket; and a socket for receiving the tip of a screwdriver parallel to a plug insertion direction, wherein the latch spring may be displaced into an unlocked position by inserting the screwdriver into the socket or by turning the screwdriver in the socket, whereby a latching connection of the plug latching elements of the plug to the socket latching elements of the plug socket is released.

* * * * *